US006125875A

United States Patent [19]

Dempsey et al.

[11] Patent Number: 6,125,875

[45] Date of Patent: Oct. 3, 2000

[54] PULLOUT FAUCET VALUE BODY WITH INTEGRAL VACUUM BREAKER HUB

[75] Inventors: James F. Dempsey, Westlake; John C. Holzheimer, Eastlake; Nagib Nasr, Westlake, all of Ohio

[73] Assignee: Moen Incorporated, North Olmsted, Ohio

[21] Appl. No.: 09/263,577

[22] Filed: Mar. 8, 1999

[51] Int. Cl.[7] ..... E03C 1/10

[52] U.S. Cl. ..... 137/217; 137/218

[58] Field of Search ..... 137/217, 218

[56] References Cited

U.S. PATENT DOCUMENTS

| | | | |
|---|---|---|---|
| 2,655,171 | 10/1953 | Cantor . | |
| 4,185,654 | 1/1980 | Young . | |
| 4,696,322 | 9/1987 | Knapp et al. . | |
| 4,781,674 | 11/1988 | Redmond et al. . | |
| 4,805,661 | 2/1989 | Knapp et al. . | |
| 4,904,236 | 2/1990 | Redmond et al. . | |
| 4,969,483 | 11/1990 | Knapp | 137/217 X |
| 4,976,279 | 12/1990 | King, Sr. et al. . | |
| 5,009,247 | 4/1991 | Oberdorfer . | |
| 5,038,814 | 8/1991 | Gayton et al. . | |
| 5,123,437 | 6/1992 | Egli et al. . | |
| 5,213,131 | 5/1993 | Gnauert et al. . | |
| 5,325,885 | 7/1994 | Ivan et al. . | |
| 5,329,957 | 7/1994 | Semchuck et al. . | |
| 5,575,424 | 11/1996 | Fleischmann | 137/218 X |

*Primary Examiner*—Gerald A. Michalsky

*Attorney, Agent, or Firm*—McEachran, Jambor, Keating, Bock & Kurtz

[57] ABSTRACT

A faucet includes a valve body having inlet conduits and an outlet. There is a valve control element within the valve body to control flow from the inlet conduits to the outlet. A vacuum breaker hub is mounted on the valve body and forms a chamber with the exterior of the valve body. The valve body outlet opens into the chamber. There is a vacuum breaker system on the hub which includes a plurality of openings in the hub communicating with the chamber. There is a flexible valve element on the inside of the hub which normally closes the openings. There are ribs within the chamber, extending inwardly from the hub which ribs are on opposite sides of the vacuum breaker openings to preclude the flow of fluid from the valve body outlet to the area of the chamber about the flexible valve element.

6 Claims, 3 Drawing Sheets

32
30
10
102
90
28
84
88
104
26
72
60
16
36
38
20
24
22
18
98
64
12
14
70
68
66
54
58
42
52
50
5
74
76
80
62

Fig. 5.
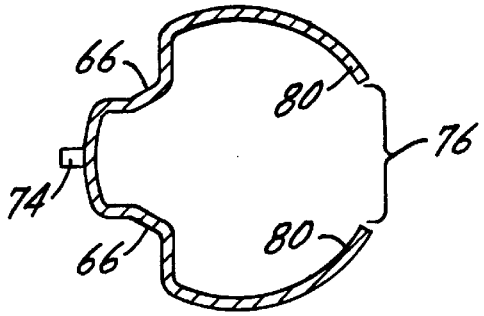
Fig. 6.
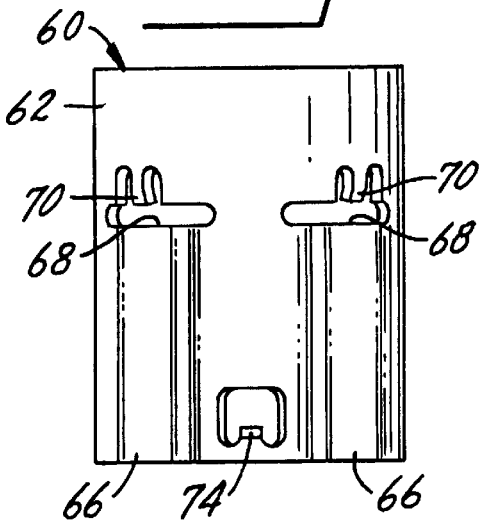
Fig. 7.
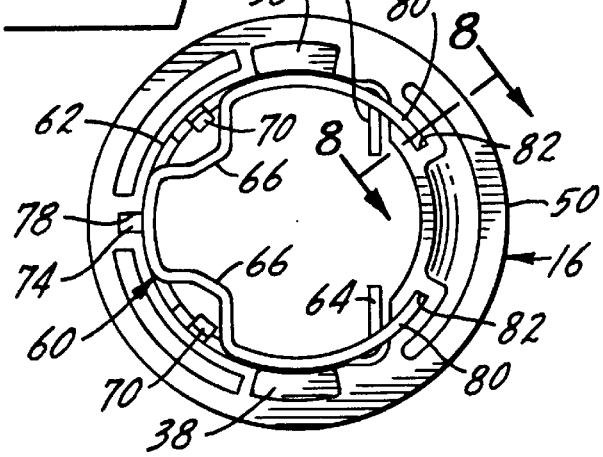
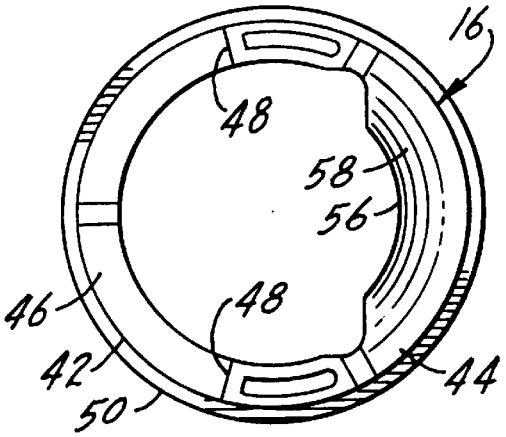
Fig. 9.
Fig. 11.
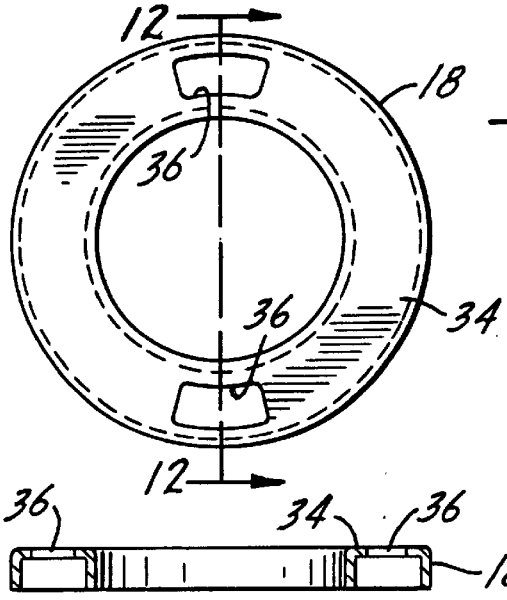
Fig. 12.
Fig. 8.
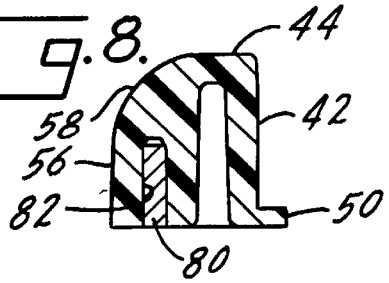
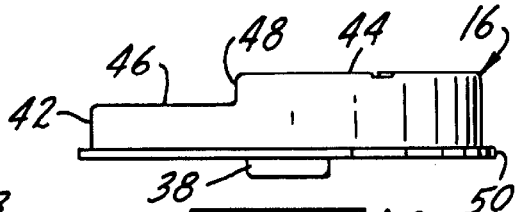
Fig. 10.

Fig. 13.
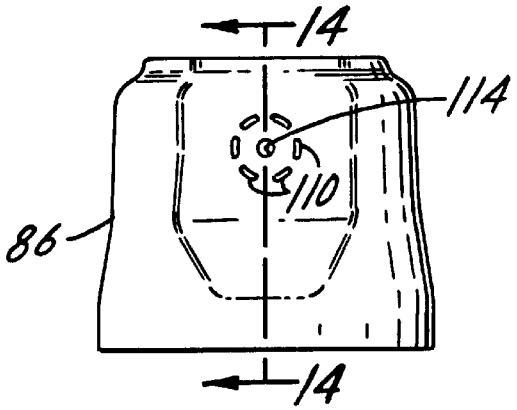
Fig. 14.
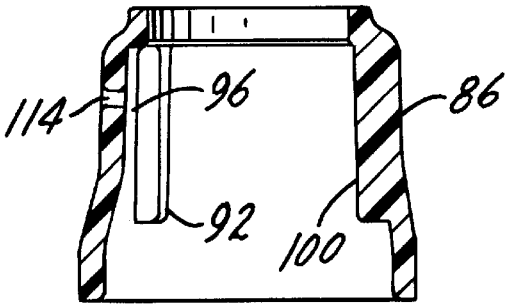
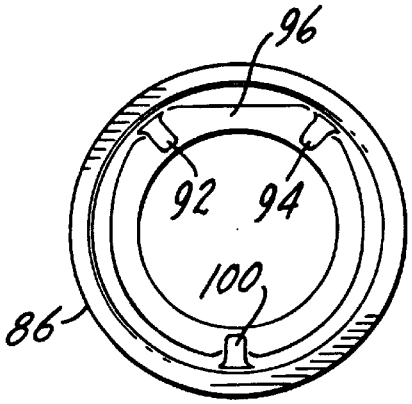
Fig. 15.
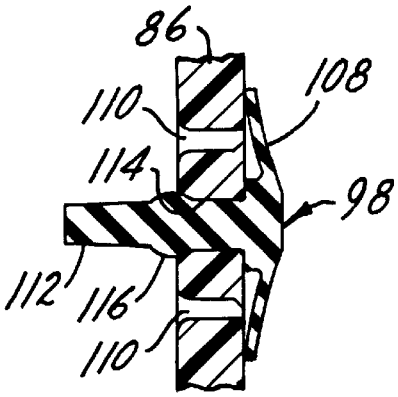
Fig. 16.
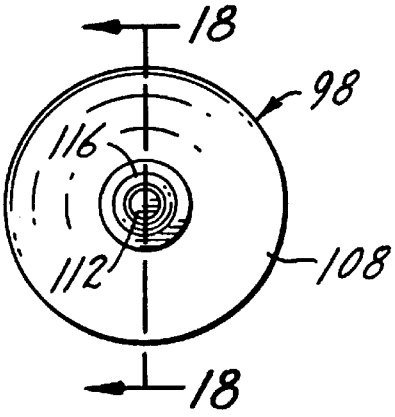
Fig. 17.
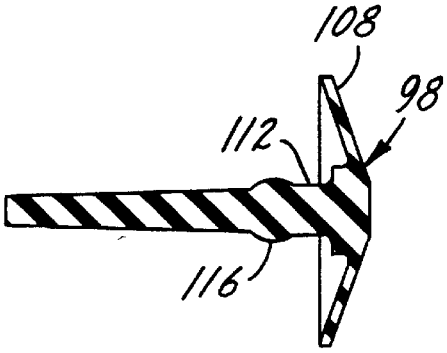
Fig. 18.

PULLOUT FAUCET VALUE BODY WITH INTEGRAL VACUUM BREAKER HUB

THE FIELD OF THE INVENTION

The present invention relates to faucets, more specifically pullout faucets and particularly an integral vacuum breaker for such a faucet. Vacuum breaker assemblies are required in faucets in which there is any potential for the faucet spout to be positioned in a body of water within the sink. A negative pressure in the water supply, in such an instance, could result in the backflow of water from the sink, through the faucet valve to the potable water supply. Thus, the requirement for a vacuum breaker which, as the name implies, eliminates the negative pressure which might draw water from the sink back toward the faucet valve body.

In particular the present invention provides a vacuum breaker which includes a hub which is made of a composite non-metallic material and which includes vacuum breaker openings and an umbrella shaped vacuum breaker. The hub is positioned on the faucet valve body and forms a chamber with the exterior of the facet valve body. The outlet of the faucet valve body is in communication with the chamber and there are ribs on the hub which isolate the vacuum breaker openings from the valve body outlet so as to prevent contamination from water flow through the valve body form reaching the flexible valve vacuum breaker element.

SUMMARY OF THE INVENTION

The present invention relates to faucets and more particularly to a vacuum breaker for a pullout wand faucet.

A primary purpose of the invention is to provide a vacuum breaker for use in a pullout wand type of faucet in which the seal element of the vacuum breaker is protected from contamination.

Another purpose of the invention is to provide a vacuum breaker assembly for the described environment in which the vacuum breaker seal, umbrella like in shape, is isolated from the normal flow of water through the valve body.

Another purpose is a vacuum breaker assembly as described in which there is a vacuum breaker hub, located on the valve body, and defining a chamber therewith, the chamber having ribs to isolate the vacuum breaker openings from the flow of water thru the valve body.

Another purpose is a simply constructed reliably operable and easily repairable vacuum breaker assembly for a pullout wand type of faucet.

DESCRIPTION OF THE DRAWINGS

The invention is illustrated diagrammatically in the following drawings wherein:

FIG. 5 is a section along plane 5—5 of FIG. 3;

FIG. 6 is a rear view of the stand;

FIG. 7 is a bottom view of the stand and bearing support member;

FIG. 8 is a section along plane 8—8 of FIG. 7;

FIG. 9 is a top view of the bearing support member;

FIG. 10 is a side view of the bearing support member;

FIG. 11 is a top view of the escutcheon positioned between the receptor and stand;

FIG. 12 is a section along plane 12—12 of FIG. 11;

FIG. 13 is a side view of the faucet body hub;

FIG. 14 is a section along plane 14—14 of FIG. 13;

FIG. 15 is a bottom view of the hub;

FIG. 16 is a side view of the hub mounted vacuum breaker;

FIG. 17 is an end view of the vacuum breaker; and

FIG. 18 is a section along plane 18—18 of FIG. 17;

DESCRIPTION OF THE PREFERRED EMBODIMENT

Figures 1, 2, 3, 4:
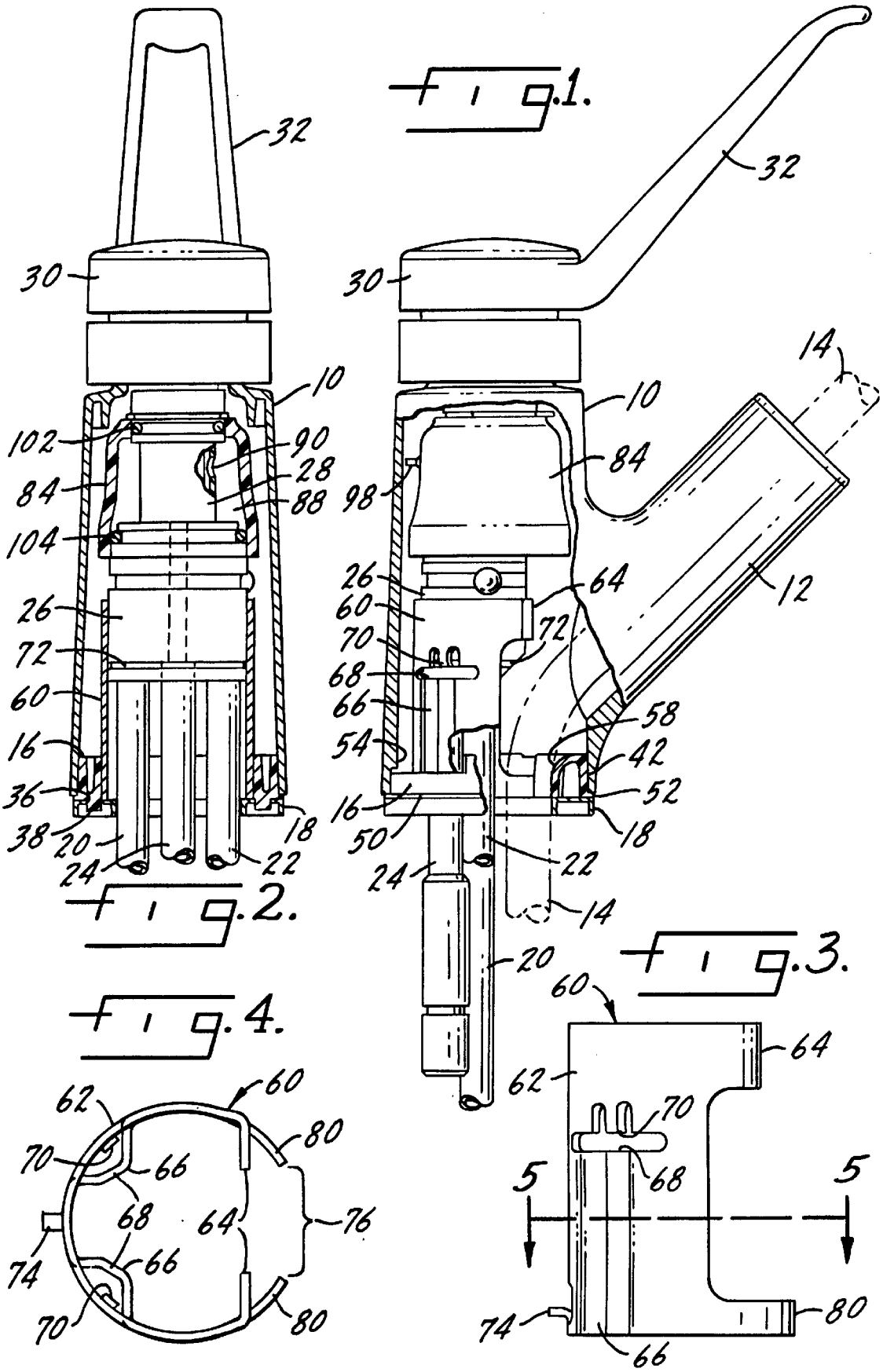
FIG. 1 is a side view of a faucet assembly of the type described, in part section.
FIG. 2 is a rear view of the faucet assembly of FIG. 1, in part section.
FIG. 3 is a side view of the support stand.
FIG. 4 is a top view of the stand.

FIG. 1 illustrates a pullout wand faucet, customarily found in the kitchen and which includes a receptor indicated generally at 10 which has a spout support portion 12 which will receive the faucet wand, not shown. The hose for the faucet wand is indicated at 14 in broken lines and extends through the faucet assembly from the wand down to the area beneath the sink deck. The receptor 10, which may be formed of plastic or of a metallic material, and which will be decorative in nature, encloses the valve body assembly and is mounted for rotation upon a bearing member 16. The bearing member 16 in turn is seated upon an escutcheon 18 which is in the form of a ring, and is illustrated in FIGS. 11 and 12. Other forms of escutcheons clearly are acceptable to support the valve assembly shown herein.

There are hot and cold water inlet conduits 20 and 22 and there is an outlet conduit 24 which will be connected to the hose 14. The conduits 20, 22 and 24 all extend into a valve body 26 which may contain a single lever valve control cartridge of the type sold by applicant, Moen Incorporated, under the trademark 1225. This cartridge is located within a cylindrical portion 28 of the valve body 26 and will have an upwardly extending stem to which will be connected the cap assembly indicated at 30 and the lever 32. Manipulation of the lever 32 will control the volume and temperature of water supplied through the hose and thus discharged from the faucet wand.

The escutcheon or ring 18 has a top surface 34 with a pair of limited arcuate slots 36 which slots will receive the downwardly extending arcuate projections 38 on the bottom of the bearing member 16, illustrated in detail in FIGS. 9 and 10 and shown combined with the stand in FIG. 7. The bearing member 16 which is preferably formed of plastic to provide electrolytic isolation between the metallic ring or escutcheon 18 and the metallic valve body 26 provides support for rotation of the receptor 10. Member 16 has an upstanding vertical wall 42 which has a first portion 44 of a greater vertical height than a second portion 46 with the junction between the portions 44 and 46 forming vertical stops 48 which limit rotation of the receptor 10. The member 16 has an outwardly extending circumferential or peripheral flange 50 which provides support for the bottom surface 52 of the receptor 10. Thus, the receptor 10 may rotate upon the bearing member and its interior surface 54 will contact the stops 48 to limit its rotation. In prior faucet assemblies of this type, rotation of the receptor was customarily limited to approximately 85 degrees. However, with the support assembly described herein, spout rotation has been expanded to approximately 145 degrees. This is clearly shown in FIG. 9.

The bearing member 16 has an arcuate portion 56, illustrated in FIG. 9 and in section in FIG. 8, which has a gradually curved surface 58 which curved surface will face the spout portion 12 of the receptor when the valve assembly is mounted on a sink deck. The hose 14 thus has a smooth non-metallic surface over which it will move when the wand is pulled out of the receptor. This is in contrast to prior art structures in which there was no such smooth non-metallic surface for movement of the hose which normally has a metallic outer sheath and thus there was both noise from hose movement and wear on the exterior of the hose. The present invention eliminates both the noise and the wear problem by the use of a non-metallic bearing member which has a curved surface over which the hose may move.

The valve body 26, which preferably is made of brass, is supported within the faucet assembly by a stand 60 illustrated in FIGS. 3, 4, 5 and 6, and in assembled version with the bearing member, in FIG. 7. Preferably the stand is formed of stainless steel. The stand must be inexpensive, but it must withstand the installation load of the faucet body without deforming and thus altering the specific orientation of the valve body. The stand must have sufficient clearance to allow the hose to move freely when the spout rotates and the material forming the stand should be similar to brass in terms of electromotive force to reduce the potential for corrosion due to electrolytic activity. The preferred material for the stand is thus stainless steel.

The stand has a generally vertical wall 62, the upper end of which has two inwardly extending tabs or projections 64 which will secure the valve body in position by bearing against a portion thereof as shown in FIG. 1. Thus, the upper end of the stand securely holds the valve body in position. The stand has two vertical ribs indicated at 66 which not only increase the vertical strength of the stand but provide a shelf at their upper end surfaces 68 for support of the valve body. The valve body 26 is held by the tabs 64 and is seated upon the vertical ribs 66. Further, the vertical wall 62 of the stand has a pair of in turned projections 70 which will extend into an annular groove 72 on the exterior of the valve body. The valve body, when assembled, will be pushed down into the stand until the projections 70 snap into the groove 72, thus permanently holding the valve body within the stand. The interengagement between the valve body and the stand includes the ribs 66, the tabs 64 and the projections 70, all combining to firmly hold the valve body in position within the stand.

The lower portion of the stand will interlock with the bearing member 16. As shown particularly in FIG. 4, a rear portion of the stand has a generally horizontally extending projection 74 which is opposite a spout opening 76 in the stand, which opening is there to accommodate movement of the hose. The projection 74 will be received within a recess 78 in the bearing member 16, as particularly shown in FIG. 7. This properly aligns the stand with the bearing member and the bearing member, as discussed above, is properly aligned with the escutcheon on the sink deck by the slots 36 and projections 38. To further hold the stand within the bearing member, the lower portion of the stand has a pair of arcuately extending projections 80, shown in FIG. 5 which will extend within arcuate grooves 82 in the lower, downwardly facing portion, of the bearing member 16. This interlocking arrangement is shown particularly in FIG. 7. The arcuate projections or extensions 80 and the mating grooves 82 on the stand and bearing member combined with the aligning projection 74 and the recess 78 all together serve to not only positively and firmly connect the stand with the bearing member, but also to align these two elements so that the entire faucet assembly will be properly located on the sink deck.

As is common and required in faucets of this kind, there must be a vacuum breaker. In the present instance, at the upper portion of the valve body, there is a vacuum vent assembly 84 which includes a non-metallic hub 86 extending over the upper portion of the valve body adjacent to the location of the valve cartridge. The area inside of the hub 86 will form a chamber 88 which will receive water discharged from the valve cartridge through outlet port 90. The hub 86 as shown in FIGS. 14 and 15 may have three downwardly extending ribs, two of which, indicated at 92 and 94, are positioned closely adjacent to the vacuum breaker 98 to define a vacuum breaker chamber 96. The ribs 92 and 94 isolate water discharged from the cartridge, which may contain contamination such as sediment, from the vacuum breaker. In prior art vacuum breakers, the seal element was exposed to direct water flow which allowed contamination to get under the seal surface. This is prevented in the present construction by the use of the ribs 92 and 94. There is a third rib 100 which assists in locating the hub on the exterior surface of the valve body 26. The hub is preferably formed of plastic and will be sealed at its upper and lower extremities by seal rings 102 and 104 which are formed on the cylindrical portion 28 of the valve body which encloses the cartridge. The ribs 92, 94 and 100 each have a lower surface 93 which contacts a shelf 95 on the valve body 26 to locate the hub on the valve body.

The vacuum breaker itself, indicated at 98 is elastomeric in form and has an umbrella portion 108 which masks a group of openings 110 in the wall of the hub 86. There is a stem 112 which extends through a hole 114 in the hub with the stem having an enlargement 116 which serves to fix the vacuum breaker to the hub.

In normal use, the umbrella portion 108 will close over the openings 110 so that no water is discharged from the hub. The outside of the hub will be at atmospheric pressure. In the event that there is a drop in line pressure supplying the faucet, and if at that time the wand were to be located in water within a sink, the negative pressure from the water supply could draw unclean water from the sink back through the faucet assembly into the water supply. However, this is prevented by the vacuum breaker assembly as if such a negative pressure were to occur, the atmospheric air outside of the hub would force its way inward, pushing the umbrella portion 108 away from the holes 110 and breaking the vacuum, preventing the backward flow of water from the sink through the faucet assembly into the potable water supply.

The ribs 92, 94 and 100 provide both isolation for the vacuum breaker openings and locator stops for the hub 86.

Whereas the preferred form of the invention has been shown and described herein, it should be realized that there may be many modifications, substitutions and alterations thereto.

What is claimed is:

1. A faucet including a valve body having inlet conduits and an outlet, valve control means within said valve body to control the flow of fluid from said inlet conduits to said outlet, a vacuum breaker hub mounted on said valve body and forming a chamber with the exterior of said valve body, said valve body outlet opening into said chamber;

a vacuum breaker system on said hub and including a plurality of openings in said hub communicating with said chamber, a flexible valve element on the inside of said hub and normally closing said plurality of openings; and means within said chamber isolating said hub vacuum breaker openings from said valve body outlet to prevent the flow of water from said outlet to an area of said chamber about said flexible valve element, said isolating means including a pair of peripherally spaced ribs on the interior of said hub, one on each side of said flexible valve element.

2. The faucet of claim 1 further including a third rib, generally equally spaced from said peripherally spaced ribs, with all of said ribs extending from said hub toward said valve body.

3. The faucet of claim 1 wherein said peripherally spaced ribs function as stops to locate said hub on said valve body.

4. The faucet of claim 1 wherein said hub includes a flattened area, with said plurality of openings being located at said flattened area.

5. The faucet of claim 1 wherein said flexible valve element is in the shape of an umbrella, having a flexible top which overlies said hub openings and a stem which extends through said hub.

6. The faucet of claim 5 wherein said hub has an opening for said stem, which stem opening is generally centrally located within said plurality of hub vacuum breaker openings.

* * * * *